US007097595B1

(12) United States Patent
Wang

(10) Patent No.: US 7,097,595 B1
(45) Date of Patent: Aug. 29, 2006

(54) FOLD-UP MECHANISM FOR AN ELECTRIC TREADMILL

(76) Inventor: Leao Wang, No.1, Lane 233, Sec. 2, Charng Long Rd., Taiping (TW) 411

( * ) Notice: Subject to any disclaimer, the term of this patent is extended or adjusted under 35 U.S.C. 154(b) by 0 days.

(21) Appl. No.: 11/123,159

(22) Filed: May 6, 2005

(51) Int. Cl.
*A63B 22/00* (2006.01)

(52) U.S. Cl. ..... 482/54

(58) Field of Classification Search ..... 482/51, 482/54

See application file for complete search history.

(56) References Cited

U.S. PATENT DOCUMENTS

| | | | | |
|---|---|---|---|---|
| 5,733,228 | A * | 3/1998 | Stevens | 482/54 |
| 6,015,368 | A * | 1/2000 | Clem et al. | 482/54 |
| 6,325,745 | B1 * | 12/2001 | Yu | 482/54 |
| 6,461,275 | B1 * | 10/2002 | Wang et al. | 482/8 |
| 6,475,121 | B1 * | 11/2002 | Wang et al. | 482/54 |

* cited by examiner

*Primary Examiner*—Stephen R. Crow
(74) *Attorney, Agent, or Firm*—Troxell Law Office, PLLC

(57) ABSTRACT

A fold-up mechanism for an electric treadmill having a single lifting motor for bringing a main frame thereof in a tilt and a fold-up position. The lifting motor and a transmission spindle are positioned between both inverted T-bases. A slide tube with a female threaded hole is threadedly mounted on the transmission spindle. An opposing end of the slide tube is pivotally coupled to a lifting rod. Meanwhile, a front cross bar is attached to an opposing end of the lifting rod. Two handrails are extended upwardly from both side of the front cross bar. Moreover, one end of the main frame is pivotally attached to middle bars of the inverted T-bases while a telescopic unit and a pull rod are pivotally coupled at a first end thereof to the bottom end of the main frame as well as at a second end thereof to slide tube and the lifting rod, respectively. In this way, when the lifting motor comes into operation to impart motion to the transmission spindle for an in-place rotation, the slide tube undergoes a reciprocating displacement, thereby bringing the main frame in a tilted and a fold-up position.

13 Claims, 3 Drawing Sheets

FOLD-UP MECHANISM FOR AN ELECTRIC TREADMILL

BACKGROUND OF THE INVENTION

1. Fields of the Invention

The invention relates to a fold-up mechanism for an electric treadmill, and more particularly, to a fold-up mechanism that employs a single lifting motor to bring a main frame in a tilt or a fold-up position.

2. Description of the Related Art

A tilting mechanism of a conventional treadmill is used to adjust the supported angle of a main frame relative to a base frame for creating a certain walking slope. Meanwhile, a fold-up mechanism is used to fold-up the main frame in a storage position for reducing the space occupied by the treadmill. Generally speaking, these can be classified into a manual and an automatic type. The present invention is an improvement of the above-mentioned mechanisms.

U.S. Pat. No. 5,733,228 teaches a mechanism with a lifting motor, pull cable, pulley wheels and return springs to fold-up a main frame of a treadmill between two handrails. Therefore, the main frame can be lifted in a tilt and a fold-up position. Although this prior art has its original design, the mechanism requires complicated and miscellaneous components. In addition, the pull cable and the return springs are subject to fatigue and slack. This is regarded as drawbacks of this prior art.

Another prior art U.S. Pat. No. 6,325,745 teaches a treadmill with its main frame pivotally coupled to a slide groove of a base. Meanwhile, a lifting motor pushes downwardly a supporting rod pivotally attached to the main frame. In this way, the main frame is swivelable in the slide groove to be lifted in a storage position. However, this apparatus doesn't have the function to bring the main frame in a tilt position. Besides, the lifting motor applied its driving force to only one end of the main frame so that the arm of force is evidently mechanically too short. Especially, the lifting motor is movable with the lifting action, and the lifting motor bears all loading created by the main frame. So, the lifting motor is subject to overload that would cause damage to the lifting motor.

A further prior art U.S. Pat. No. 6,015,368 teaches a treadmill with a longer spindle and sleeve to support a rear supporting rod at a bottom end behind a main frame over a long distance to fold-up the main frame. Also, this prior art doesn't have the function of tilting the main frame. Moreover, a lifting motor has to be movable with the lifting action. Thus, it has the same disadvantages as U.S. Pat. No. 6,325,745.

SUMMARY OF THE INVENTION

Thus, based on the above described considerations, the designer would like to employ a lifting motor, a transmission spindle, a slide tube, a lifting rod, a telescopic unit and a pull rod to pivot a main frame of the treadmill about pivoting points between the main frame and the telescopic unit as well as between the main frame and a pull rod to lift the main frame in a tilt and a fold-up position. In this way, the main frame of the treadmill can be lifted with less torque output of the lifting motor. As a result, the service life of the lifting motor can be effectively extended. Meanwhile, the supporting force is easily controlled. This is the main object of the invention.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
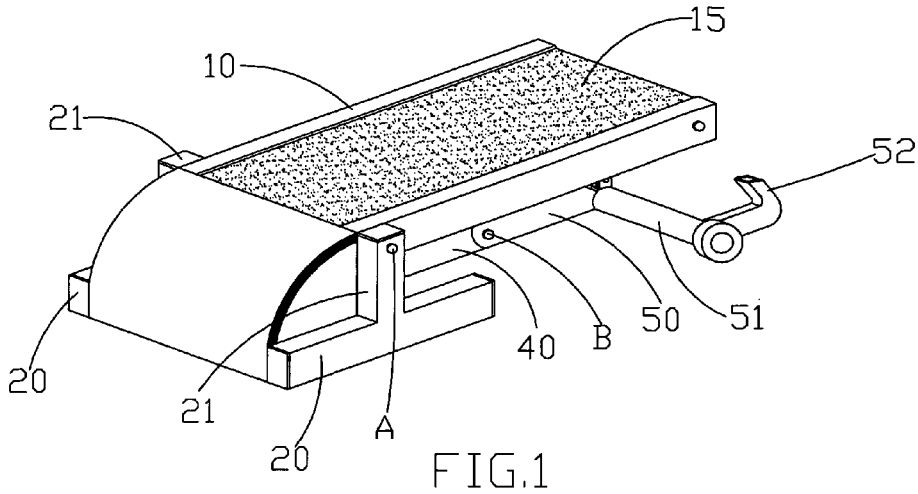
FIG. 1 is a perspective view of a preferred embodiment of the invention.
Figure 2:
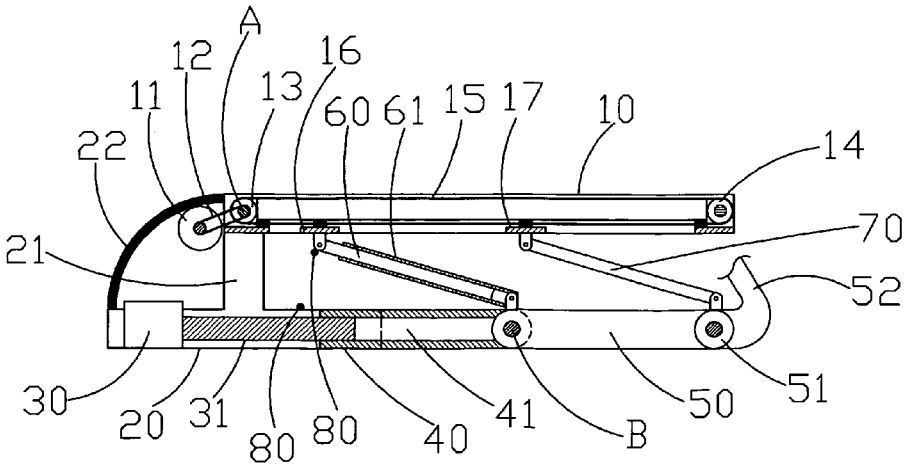
FIG. 2 is an axially cutaway view of the preferred embodiment of the invention in accordance with FIG. 1.

Referring to FIGS. 1 and 2, an electric treadmill in accordance with the invention includes a main frame 10, two opposing inverted T-bases 20, a lifting motor 30, a slide tube 40, a lifting rod 50, a telescopic unit 60 and a pull rod 70.

The inverted T-bases 20 each include a middle bar 21.

The main frame 10 is pivotally interposed between both middle bars 21 of the inverted T-bases 20 and includes two side bars defining a continuous moving belt 15 movably installed between a rear and a front roller 13, 14. The rear roller 13 is driven via a transmission belt 12 by a motor 11 while the front roller 14 is brought into rotation via the continuous moving belt 15.

The lifting motor 30 includes an output shaft that is coupled to a transmission spindle 31 for an in-place rotation.

The slide tube 40 includes a female threaded hole 41 for threadedly mounting the slide tube 40 on the transmission spindle 31.

The lifting rod 50 is pivotally coupled to a rear end of the slide tube 40. An opposing end of the lifting rod 50 is attached to a front cross bar 51. Two handrails 52 are extended upwardly from both opposing sides of the front cross bar 51.

The telescopic unit 60 includes a sleeve 61 telescopically mounted thereon. The telescopic unit 60 has a first end and a second end. The first and the second end thereof are pivotally attached to a first transverse member 16 and the rear end of the slide tube 40, respectively.

The pull rod 70 includes a first end and a second end. The first and the second end thereof are pivotally attached to a second transverse member 17 and the rear end of the lifting rod 50, respectively.

Figure 3:
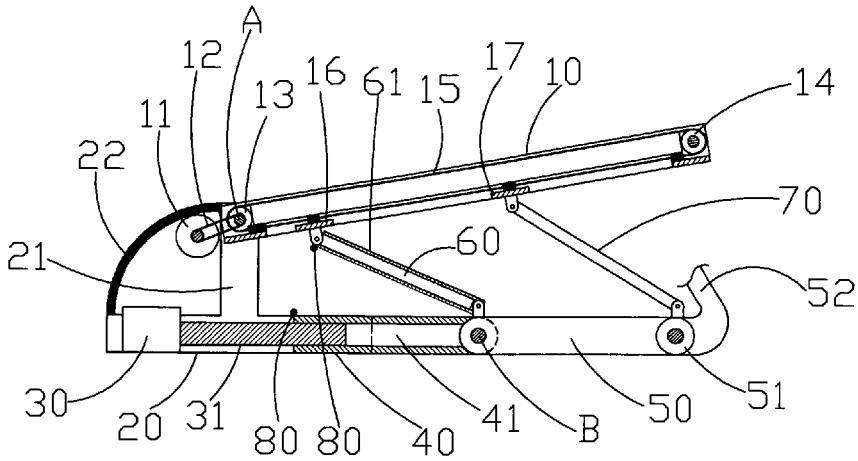
FIG. 3 is an axially cutaway view of the preferred embodiment of the invention in accordance with FIG. 1, showing the action to bring a main frame in a tilt position.
Figure 4:
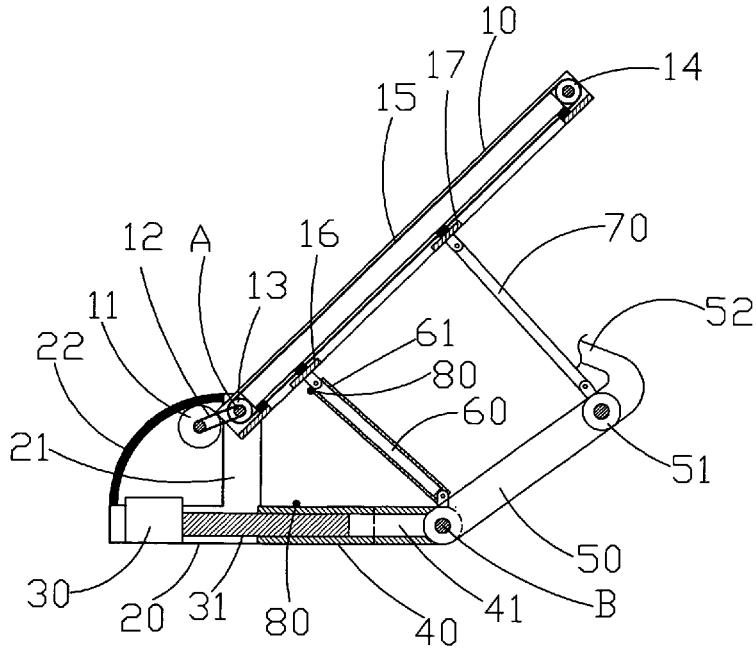
FIG. 4 is an axially cutaway view of the preferred embodiment of the invention in accordance with FIG. 1, showing the action to lift a main frame in a fold-up position.
Figure 5:
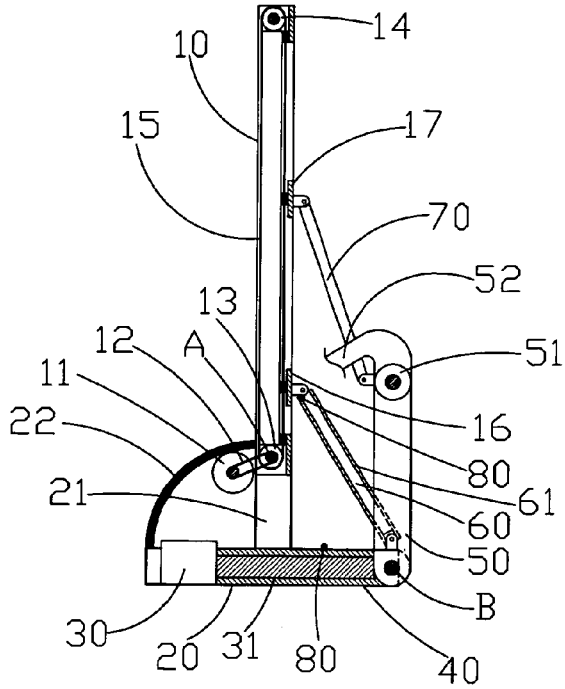
FIG. 5 is an axially cutaway view of the preferred embodiment of the invention in the fold-up position.

The lifting action of the electric treadmill in accordance with the invention is illustrated in FIGS. 2 through 5. When the lifting motor 30 comes into operation to impart motion to the transmission spindle 31 for an in-place rotation, the slide tube 40 undergoes a reciprocating displacement. FIGS. 2 and 3 particularly illustrate the process in tilting the main frame 10. At that time, the main frame 10 pivots about a swivel pin A in the middle bar 21 of the inverted T-bases 20 to allow for a simulation of an uphill and a flat surface. FIGS. 4 and 5 illustrate the process in lifting the main frame 10 in a storage position. In other words, when the sleeve 61 of the telescopic unit 60 is moved to an end stop, as shown in FIG. 2, and the slide tube 40 is continuously moved toward the lifting motor 30, the telescopic unit 60 will be lifted gradually until the main frame 10 is brought in an upright position. Due to the pivotal connection between the lifting rod 50 and the slide tube 40, the lifting rod 50 pivots upwardly about a swivel pin B by the pull force of the pull rod 70.

In order to bring the main frame 10 in operational position, the slide tube 40 is extended by the lifting motor 30 in a reverse drive direction.

In light of the safety, a protection cover is arcurately extended between both inverted T-bases 20 to prevent the internal transmission units from direct exposure to the outside.

In order to separate the tilting action from the fold-up action as well as to prevent the lifting motor 30 from over-driving, a sensing switch 80 is mounted at a proper place of the traveling path of the telescopic unit 60 or the slide tube 40. Accordingly, the tilting action from the fold-up action can be effectively controlled by contact or release of the sensing switch 80.

A simple example will be described to detail the action of the sensing switch 80 as follows:

When any sensing switch 80 is touched during the operation of the motor 11 and the continuous moving belt 15, it is programmed that the main frame 10 is located at a highest point of the tilting action so that no more lifting action is permitted. In this way, the lifting motor 30 can be only operated in a reverse manner to lower the tiling angle of the main frame 10 relative to the inverted T-bases 20. Besides, the sensing switch 80 is inoperative when the continuous moving belt 15 is out of operation. This results in a better safety in use.

Figure 6:
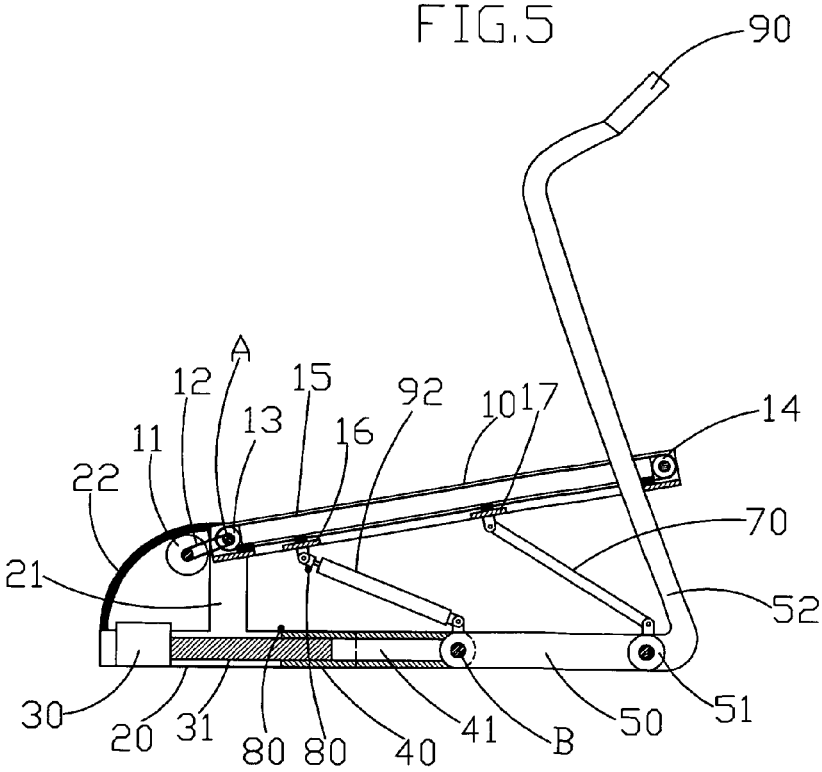
FIG. 6 is an axially cutaway view of a further preferred embodiment of the invention.

As shown in FIG. 6, both handrails 52 are extended upwardly from both opposing sides of the front cross bar 51 and integrated to a handrail frame at a certain place. A control console 90 with a microprocessor and related control programs is mounted on the handrail frame. The electric treadmill can be controlled by use of the control console 90.

The telescopic unit 60 can be replaced by a pneumatic, a hydraulic cylinder (not shown) or other equivalent units for both enhancing the lifting effect and reducing the loading of the lifting motor 30.

Many changes and modifications in the above-described embodiments of the invention can, of course, be carried out without departing from the scope thereof. Accordingly, to promote the progress in science and the useful arts, the invention is disclosed and is intended to be limited only by the scope of the appended claims.

What is claimed is:

1. A fold-up mechanism for an electric treadmill, comprising:

a) two inverted T-bases each having a middle bar extending upwardly from the middle of a base plate thereof;

b) a main frame pivotally interposed between both middle bars of the inverted T-bases, the main frame having two side bars defining a continuous moving belt movably installed between a rear and a front roller, the rear roller being driven via a transmission belt by a motor while the front roller is brought into rotation via the continuous moving belt;

c) a lifting motor fixedly positioned under the main frame between the inverted T-bases, the lifting motor having an output shaft coupled to a transmission spindle for an in-place rotation;

d) a slide tube having a female threaded hole for threadedly mounting the slide tube on the transmission spindle;

e) a lifting rod pivotally coupled to a rear end of the slide tube, an opposing end of the lifting rod being attached to a front cross bar, two handrails being extended upwardly from both opposing sides of the front cross bar;

f) a telescopic unit includes a sleeve telescopically mounted thereon, the telescopic unit having a first end and a second end, the first and the second end thereof being pivotally attached to a first transverse member and the rear end of the slide tube, respectively;

g) a pull rod having a first end and a second end, the first and the second end thereof being pivotally attached to a second transverse member and the rear end of the lifting rod, respectively, whereby, when the lifting motor comes into operation to impart motion of the transmission spindle for an in-place rotation, the slide tube undergoes a reciprocating displacement, thereby bringing the main frame in a tilted and a fold-up position.

2. The fold-up mechanism for an electric treadmill as claimed in claim 1 wherein a sensing switch is mounted on a traveling path of the telescopic unit and the slide tube.

3. The fold-up mechanism for an electric treadmill as claimed in claim 1 wherein both handrails are extended upwardly from both opposing sides of the front cross bar and integrated to a handrail frame at a certain place, and a control console is mounted on the handrail frame.

4. The fold-up mechanism for an electric treadmill as claimed in claim 1 wherein the telescopic unit includes a pneumatic cylinder.

5. The fold-up mechanism for an electric treadmill as claimed in claim 1 wherein the telescopic unit includes a hydraulic cylinder.

6. The fold-up mechanism for an electric treadmill comprising a lifting motor coupled to a transmission spindle to impart a linear motion to a slide tube with a female threaded hole whereby the main frame is brought in a tilt or a fold-up position responsive to the lifting action of a telescopic unit pivotally coupled to a bottom of the main frame.

7. The fold-up mechanism for an electric treadmill as claimed in claim 6 wherein a sensing switch is mounted on a traveling path of the telescopic unit and the slide tube.

8. The fold-up mechanism for an electric treadmill as claimed in claim 6 wherein the telescopic unit includes a pneumatic cylinder.

9. The fold-up mechanism for an electric treadmill as claimed in claim 6 wherein the telescopic unit includes a hydraulic cylinder.

10. A fold-up mechanism for an electric treadmill comprising:

a) a main frame;

b) a slide tube movable between retracted and extended positions and having a threaded hole located on a first end thereof;

c) a lifting rod having a first end pivotally connected to a second end of the slide tube;

d) two handrails, one of the two handrails extending upwardly from each of two opposing ends of a front crossbar of the lifting rod;

e) a telescopic unit connected at a first end thereof to a bottom of the main frame and at a second end thereof to a second end of the lifting rod;

f) a pull rod connected at a first end thereof to a bottom of the main frame and at a second end thereof to the second end of the slide tube;

g) a transmission spindle inserted into a female threaded hole of the slide tube; and h) a lifting motor connected to and controlling a movement of the transmission spindle, wherein, when the slide tube is located in the extended position, the main frame and two handrails are moved to an exercise position, and, when the slide tube is located in the retracted position,, the main frame and two handrails are moved to a storage position.

11. The fold-up mechanism according to claim 10, further comprising a sensing switch mounted along a traveling path of the telescopic unit and the slide tube.

12. The fold-up mechanism according to claim 10, wherein the telescopic unit includes a pneumatic cylinder.

13. The fold-up mechanism according to claim 10, wherein the telescopic unit includes a hydraulic cylinder.

* * * * *